US012703967B2

(12) United States Patent
Frye et al.

(10) Patent No.: US 12,703,967 B2
(45) Date of Patent: Aug. 11, 2026

(54) RETRACTABLE HOSE MANAGEMENT SYSTEM

(71) Applicant: Kohler Co., Kohler, WI (US)

(72) Inventors: Jacob Frye, Sheboygan Falls, WI (US); Erich Slothower, Kohler, WI (US)

(73) Assignee: Kohler Co., Kohler, WI (US)

( * ) Notice: Subject to any disclaimer, the term of this patent is extended or adjusted under 35 U.S.C. 154(b) by 149 days.

(21) Appl. No.: 18/582,178

(22) Filed: Feb. 20, 2024

(65) Prior Publication Data

US 2024/0301670 A1 Sep. 12, 2024

Related U.S. Application Data

(60) Provisional application No. 63/489,382, filed on Mar. 9, 2023.

(51) Int. Cl.
*E03C 1/04* (2006.01)

(52) U.S. Cl.
CPC .... *E03C 1/0404* (2013.01); *E03C 2001/0415* (2013.01)

(58) Field of Classification Search
CPC ..... E03C 1/0404; E03C 2001/0415
See application file for complete search history.

(56) References Cited

U.S. PATENT DOCUMENTS

| | | | | |
|---|---|---|---|---|
| 5,117,859 | A * | 6/1992 | Carlson | B67D 7/40 137/355.25 |
| 6,234,192 | B1 * | 5/2001 | Esche | B65H 75/4478 251/114 |
| 10,072,402 | B2 | 9/2018 | Esche et al. | |
| 10,106,963 | B2 | 10/2018 | Esche et al. | |
| 11,192,125 | B2 | 12/2021 | Chung | |
| 11,745,193 | B2 | 9/2023 | Chung | |
| 2016/0237661 | A1 * | 8/2016 | Teagarden | E03C 1/025 |
| 2017/0356170 | A1 | 12/2017 | Esche et al. | |
| 2022/0088619 | A1 | 3/2022 | Chung | |
| 2022/0349160 | A1 * | 11/2022 | Erickson | E03C 1/04 |
| 2022/0364343 | A1 | 11/2022 | Eilmus et al. | |

FOREIGN PATENT DOCUMENTS

WO 2023114703 A1 6/2023

* cited by examiner

*Primary Examiner* — Janie M Loeppke
(74) *Attorney, Agent, or Firm* — Husch Blackwell LLP

(57) ABSTRACT

A sprayhead hose retraction system including one or more pulley assemblies having one or more pullies. Each of the one or more pullies have defined grooves configured to receive a hose, at least in part, wherein a first end of the hose is connected to a sprayhead of a faucet and wherein the hose wraps around the one or more pullies such that extension of the sprayhead moves or rotates the one or more pullies as the sprayhead extends from the faucet. When the sprayhead is released by a user, the one or more pullies provide a force onto the hose which automatically causes retraction of the sprayhead into the faucet.

13 Claims, 8 Drawing Sheets

RETRACTABLE HOSE MANAGEMENT SYSTEM

RELATED APPLICATIONS

The present disclosure claims to the benefit of U.S. Provisional Application Ser. No. 63/489,382, filed Mar. 9, 2023, which is hereby fully incorporated by reference in its entirety.

TECHNICAL FIELD

The present disclosure relates generally to the field of kitchen fixtures. In particular, the present disclosure relates to hose management assemblies for extending and retracting a sprayhead from a spout for docking.

BACKGROUND

Conventional faucets have a faucet body, one or more flow control/mixing valves, one or more control handles, and a spout. The spout acts as a conduit for expelling water that has passed through the valve(s), in which case the outflow is either fixed to begin at a single point, or in the case of a pivotal spout, is limited to begin over a range of a prescribed horizontal arc.

Faucets have conventionally been provided with separate stand-alone hand-held sprayers to provide the user with more flexibility with regard to the direction and point that outflow begins, particularly to facilitate spraying down dishware. These sprayers have a flexible hose attached to a sprayhead allowing the sprayhead to be pulled from a mount and moved about as needed. However, these faucets require extra room on the countertop for the sprayer mounting, as well as a separate hole through the countertop itself.

As an alternative, faucets with pull-out sprayheads projecting from the main faucet body have been developed. Assembly of such pull-out faucets can be more complicated than conventional faucets due to the added spray hose and its coupling to the water supply lines. The spray hose must run through the body of the faucet near the valve assembly, which itself typically includes a large number of components. Also, separate fasteners are ordinarily needed to install the valve assembly in the faucet body. This can significantly increase the cost of production of the faucet, and in some cases the shipping weight of the product. Moreover, the types of assemblies can be complex and take up a large amount of storage capacity below or near the sink. Similarly, as the sprayhead transitions between the retracted and extended positions, the hose and other movable parts may disturb, tangle up with or otherwise interfere with other hoses, waterlines, or other items stored beneath the sink or with the environment itself.

A need therefore exists for an improved extendable and retractable type faucet, particularly one that is easier to use and is more structurally compact.

SUMMARY OF THE DISCLOSURE

Non-limiting examples of the present disclosure provide a retractable sprayhead hose management system including a pulley assembly including a plurality of first pullies, and a second pulley operably coupled to the first pullies and a hose assembly body, wherein the first pullies are coupled to the body such that the first pullies remain secured to the body during operation, while maintaining rotational capability. The second pulley may be securely housed within one or more openings of the body, such that the second pulley is enabled to move vertically or axially along the body. The first pullies and second pulley each having defined grooves configured to receive a hose, at least in part, wherein a first end of the hose is connected to a sprayhead of a faucet and the second end of the hose is connected to a mixing valve positioned within the faucet. The hose wraps around the second pulley such that extension of the sprayhead from the faucet tightens the hose around the first pullies and second pulley and lifts the second pulley as the sprayhead is further extended away from the faucet. When the sprayhead is released by a user, the weight of the second pulley provides a force onto the hose such that the second pulley retracts the sprayhead back into the faucet.

One example of the present disclosure provides a sprayhead hose retraction system including a first pulley and a second pulley operably coupled within a housing of a sink and faucet assembly. In examples, the pullies may include a guide pulley and an adjacent tension pulley operably and rotatably coupled within the housing, wherein the pullies are defined with grooves configured to receive a hose, at least in part. The hose configured to be wrapped, at least partially, around the pullies such that, when a sprayhead transitions between a retracted and an extended position, the hose is pulled through the spout and about/around the pullies and, in turn, pulls together the tension pulley closer to the guide pulley. Thus, providing an extension length of hose for the sprayhead out of the spout. Upon release of the sprayhead by a user, a constant-force spring provides an amount of tension on the tension pulley to retract the sprayhead from the extended position to the retracted position.

The summary above is not intended to describe each illustrated example or every implementation of the present disclosure. The figures and the detailed description that follow more particularly exemplify these examples.

BRIEF DESCRIPTION OF THE DRAWINGS

Subject matter hereof may be more thoroughly understood in consideration of the following detailed description of various examples in connection with the accompanying figures, in which.

Figure 1:
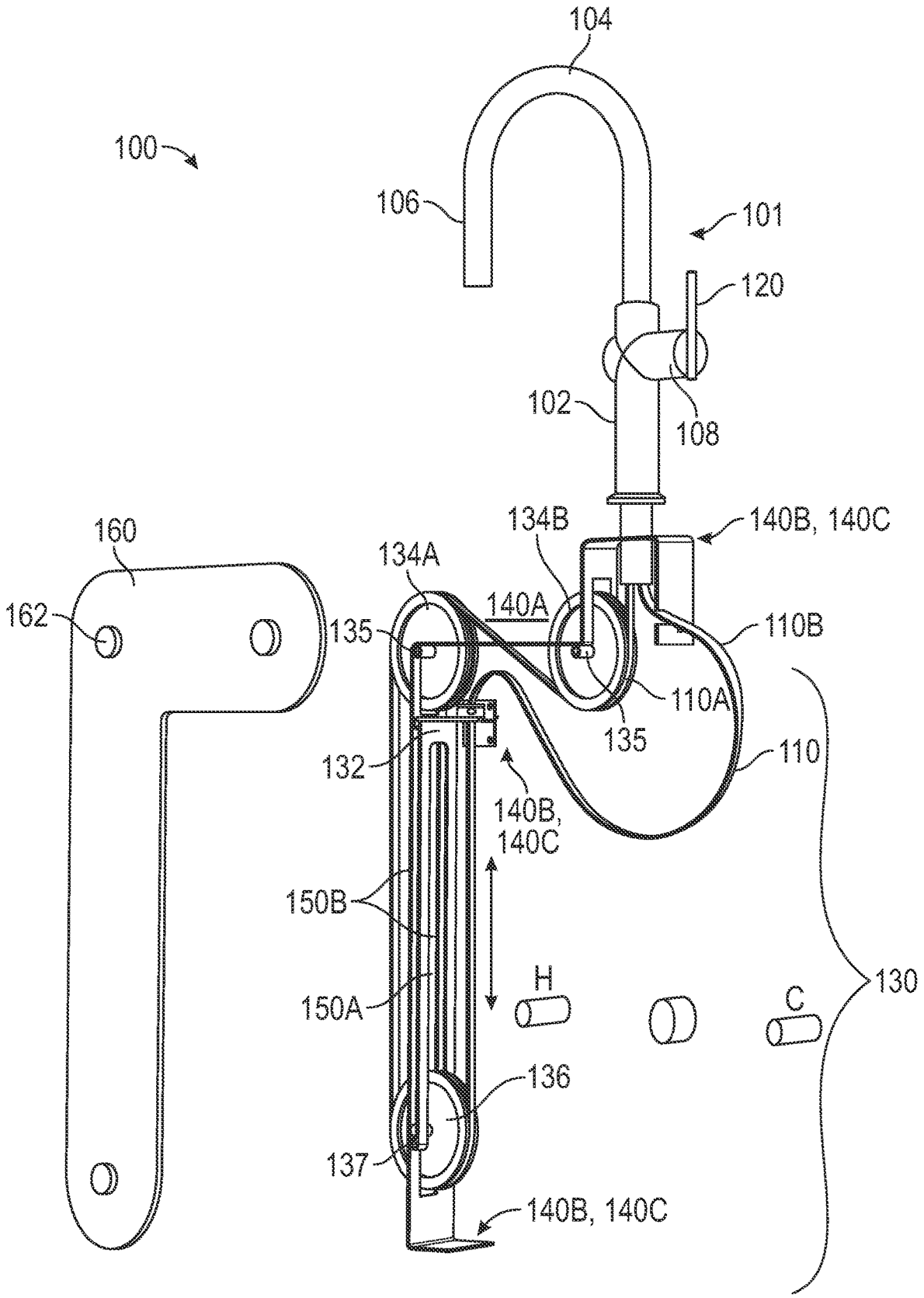
FIG. 1 depicts a perspective view of a faucet assembly with a retractable sprayhead, according to examples.

While various examples are amenable to various modifications and alternative forms, specifics thereof have been shown by way of example in the drawings and will be described in detail. It should be understood, however, that the intention is not to limit the claimed inventions to the particular examples described. On the contrary, the intention is to cover all modifications, equivalents, and alternatives falling within the spirit and scope of the subject matter of the present disclosure.

DETAILED DESCRIPTION

Before turning to the FIGURES, which illustrate certain examples in detail, it should be understood that the present disclosure is not limited to the details or methodology set forth in the description or illustrated in the figures. It should also be understood that the terminology used herein is for the purpose of description only and should not be regarded as limiting.

Referring generally to the FIGURES, a sprayhead hose retraction assembly (i.e., system) for use with faucet assemblies having a retractable spray head or hand spray is shown according to various examples. The faucet assembly generally includes a body, a spout, and a retractable sprayhead releasably coupled (e.g., removably coupled, selectively coupled, etc.) to the spout via a retractable hose. One or more hoses carry fluid through the spout from a mixing valve coupled to hot and cold waterlines to the sprayhead, where the fluid is dispensed (e.g., released, sprayed, output) to the environment, for example, into a basin, sink, tub, shower stall, etc.

Figure 2:
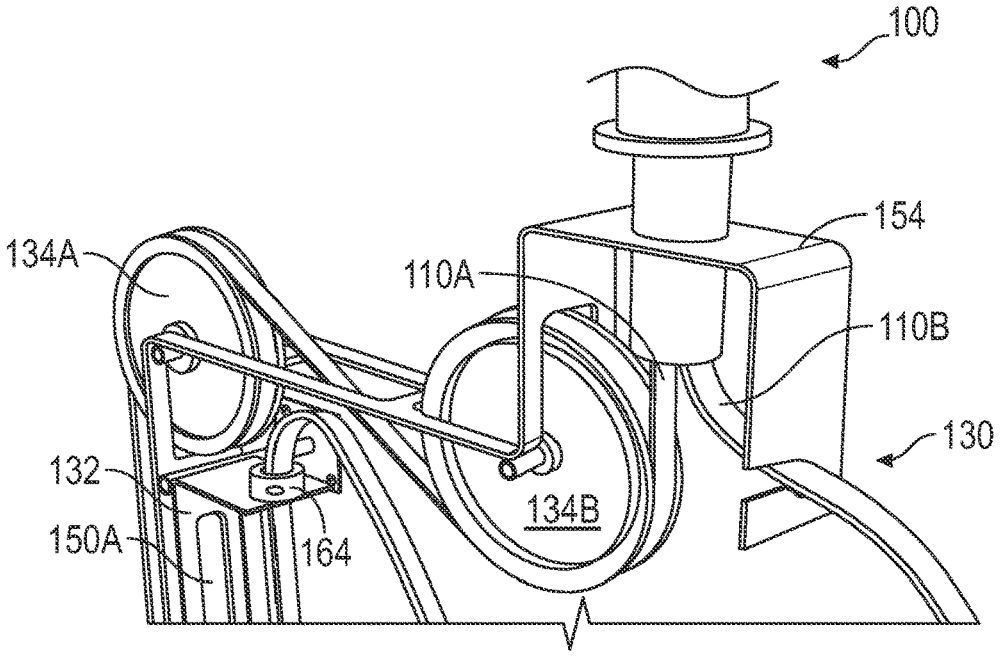
FIG. 2 depicts a perspective view of the faucet assembly depicted in FIG. 1, according to examples.
Figure 3:
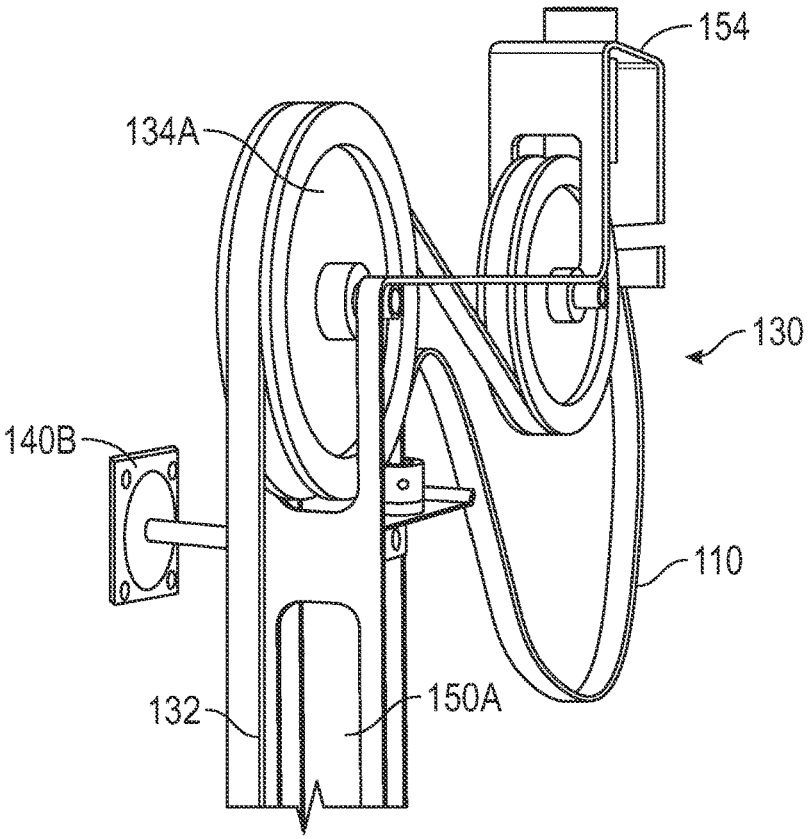
FIG. 3 depicts a side view of the faucet assembly depicted in FIG. 1, according to examples.

Referring to FIGS. 1-3, a sprayhead hose retraction system 100 for use with a faucet assembly 101 is shown, according to examples. The faucet assembly 101 and hose retraction system 100 is shown in a retracted (e.g., first, docked, retracted, etc.) position. In examples, the faucet assembly 101 is shown to include a base 102, a spout 104, and a sprayhead 106 removably coupled to (e.g., received in, engaging, etc.) the spout 104 via a hose 110 that extends within the faucet assembly 101. A first end 110A of the hose is coupled to a mixing valve (not shown) positioned within the faucet, which is in turn coupled to a hot water inlet hose or flow line (not shown) and a cold water inlet hose or flow line (not shown), each of which are coupled to a source of hot water H inlet and a source of cold water C, respectively.

In the retracted position, the sprayhead 106 may be coupled to and received in the spout 104. In examples, a sprayhead retraction system is configured to retract the sprayhead 106 from an extended position to the retracted position. Various examples of the sprayhead retraction assembly are described in greater detail below. The faucet assembly 101 is shown to include an arm 108 configured to house and support a manual or digital mixing valve (not shown). The valve may be configured to control the volume, temperature, or some combination thereof, of the fluid flow through the faucet assembly 101 via hose 110. A handle 120 is coupled to the valve to control the operation thereof. According to other examples, the faucet assembly 101 may not include an arm 108, and the valve and handle 120 may be located remotely from the faucet 101. In examples, the faucet assembly may not include an arm 108 and handle 120 and may activate fluid flow through the faucet assembly 101 by activating one or more touch sensors positioned at one or more locations on the base 102, spout 104, sprayhead 106, etc. According to various other examples, the faucet 101 may include an electronically controlled valve (e.g., solenoid valve) in addition to or instead of the manual valve.

In examples, the faucet assembly 101 is operable with the sprayhead hose retraction system 100 to transition the sprayhead 106 between a retracted position and an extended position. In examples, the faucet assembly 101 may include a fully extended position (e.g., a position in which the hose 110 may no longer be extended) and a plurality of partially extended positions (e.g., a position between the fully extended position and the retracted position). In some examples, the sprayhead hose retraction system 100 applies a force (e.g., constant force, variable force) to the hose 110 and the sprayhead 106 in the direction of the retracted position. Thus, if a user is using the sprayhead 106 in an extended position (e.g., a full or partially extended position), release of the sprayhead 106 by the user will result in the sprayhead 106 moving toward the retracted position and re-coupling with the spout 104. In examples, the transition of the sprayhead 106 between the retracted position and the extended position may be accomplished through the use of a pulley/hose assembly 130 of the sprayhead hose retraction system 100.

In examples, the pulley/hose assembly 130 may include a plurality of pullies 134A-134B and a weighted pulley 136 operably and rotatably coupled to a pulley/hose assembly body ("body") 132. In examples, pullies 134A-134B may be coupled to the body 132 via attachable members 135 such that the pullies 134A-134B may remain secured to the body 132 during operation, while maintaining rotational capability. The body 132 may be generally hollow in nature, while being structurally sound, and have a plurality of openings, for example openings 150A-150B between uprights. In examples, the weighted pulley 136 may be securely housed within the openings 150A-150B of the body 132. In examples, the weighted pulley 136 may be configured to remain within the pulley opening 150A, wherein member openings 150B are configured to receive slidable members 137 integrated with the weighted pulley 136 such that weighted pulley 136 is axially slidable along opening 150A.

In examples, the plurality of pullies 134A-134B and weighted pulley 136 with defined grooves can be configured to receive the hose 110, at least in part. In examples, the hose 110 may be coupled to a plurality of pullies 134A-134B and weighted pulley 136 such that movement of the hose 110 translates to movement of the pullies 134A-134B and 136, and vice versa. In examples, the hose 110 may be configured to be wrapped, at least partially, around the pullies 134A-134B and 136 such that, when the faucet head 106 is in the retracted position, sections of the hose 110, such as first end 110*a*, are taut with the pullies 134A-134B and 136, while a second end 110*b* remains slack outside of the body 132. In examples, when the faucet head is in the retracted position, the weighted pulley 136 remains in an idle or stationary position (e.g., at the lowest position as depicted).

When a user pulls on the sprayhead 106 to transition the sprayhead 106 out of the retracted position, the hose 110 is pulled through the spout 104 and about the plurality of pullies 134A-134B and weighted pulley 136. In examples, when the user pulls the sprayhead 106, the hose 110 is pulled through, which rotates the pullies 134A-134B (e.g., rotating pulley 134A clockwise and pulley 134B counterclockwise) and, in turn, lifts the weighted pulley 136 vertically, thus, providing an extension of length of the hose for the sprayhead 106 out of the spout 104, previously held within the pulley/hose assembly 130. The maximum length of extension is reached when weighted pulley 136 has reached the top of opening 150A.

When the user releases the sprayhead 106, the weighted pulley 136, no longer being held up by the user holding the sprayhead 106 in an extension position, the weighted pulley 136 applies a downward force onto the hose 110 (e.g., due to gravity), which in turn pulls the hose back from the spout 104 and back into the pulley/hose assembly 130, thus, transitioning the sprayhead 106 toward the spout 104. In examples, when the sprayhead 106 transitions between the retracted and extended positions, the weighted pulley 136 may glide axially or vertically (e.g., up, and down between opening 150A, while the slidable members 137 may glide vertically within member openings 150B. In examples, the pullies 134A-134B may rotate about their center axis and be configured to guide the hose through the faucet assembly. It is to be understood that while three pullies are depicted, a variety of configurations are considered. In examples, greater or fewer number of pullies 134A-134B may be incorporated to compensate for the weight of the weighted pulley 136, which would make transitioning the sprayhead 106 between the retracted and extended positions easier or more difficult. In examples, the hose remains taut to the pullies during transitions between the retracted and extended positions.

It will be understood that, while one side of the pulley/hose assembly 130 is being depicted, the opposite side is mirrored, such that the pulley assembly 130 may be adaptable to either side of the faucet. In examples, the pulley/hose assembly 130 may be reversible, such that the pulley/hose assembly 130 may be rotatable about the base 102 of the faucet and positioned to the opposite side of the faucet, rather than the side currently depicted. In examples, one or more adjustable brackets 140A-140C may be integrated with the pulley/hose assembly 130, such that the pulley/hose assembly 130, pulleys 134A-134B, weighted pulley 136, etc. may be secured (e.g., onto a wall, inside of a cabinet, below the faucet, behind the faucet, etc.). In examples, the adjustable bracket 140C, may be an adjustable foot or stand in which the pulley/hose assembly 130, at least in part, rests. In examples, the pulley/hose assembly 130 may be configured with a bracket 154 which may hold and otherwise keep separate the hot, cold and tempered hose lines out of the way (e.g., between each other and other pieces that may cause interference with the normal functions of the pulley/hose assembly 130).

In examples, the hose may include or otherwise incorporate a protruding knob 164 (more clearly depicted in FIG. 2), either partially or completely surrounding the circumference of the hose. In examples, the knob 164 may be configured to have a diameter greater than the hose. The knob 164 may be configured to prevent excess retraction of the hose 110 and limit downward momentum of the weighted pulley 136 when the sprayhead 106 is transitioning into a complete retraction position. In examples, the knob 164 may retract until it catches on one of the brackets (e.g., adjustable bracket 140B), of which the hose 110 may flow through, further preventing the weighted pulley 136 from proceeding any further within the openings (i.e., as an additional precaution measure to limit the movement of the weighted pulley 136 and prevent any damage to the faucet assembly 100).

In examples, a reversible cover 160 may be configured to integrate with the pulley/hose assembly 130. In examples, the reversible cover 160 may be shaped similarly to the design and implementation of the pullies 134A-134B, weighted pulley 136 and the hose 110, such that the reversible cover 160 may overlap and protect the pulley/hose assembly 130. In examples, knurled caps 162 may be integrated with the reversible cover 160 and may be configured to be attachable to the pulley/hose assembly 130. In examples, the knurled caps 162 may screw onto and detach therefrom the attachment members 135 of the pullies 134A-134B and 136, for ease of access to the pulley/hose assembly 130. It will be understood that while the pulley/hose assembly 130 and the reversible cover 160 may be depicted as "L" shaped, alternative configurations and structures are contemplated to facilitate extension and retraction of the sprayhead 106.

In examples, the pulley/hose assembly 130 may be configured to connect to a mixing valve (not shown), such that, prior to entering the pulley/hose assembly, mixed water (e.g., temperature regulated by the user, via the faucet arm/handle/etc.) has already been completed. Hot and cold water may be delivered from a hot fluid flow line and a cold fluid flow line (not shown) connected to hot water inlet H and cold water inlet C. In examples, pulley assembly 130 is configured to be positioned within a same vertical plane as faucet assembly 101 such that it is contained behind a sink basin and/or along a back wall of a sink cabinet.

Figure 4:
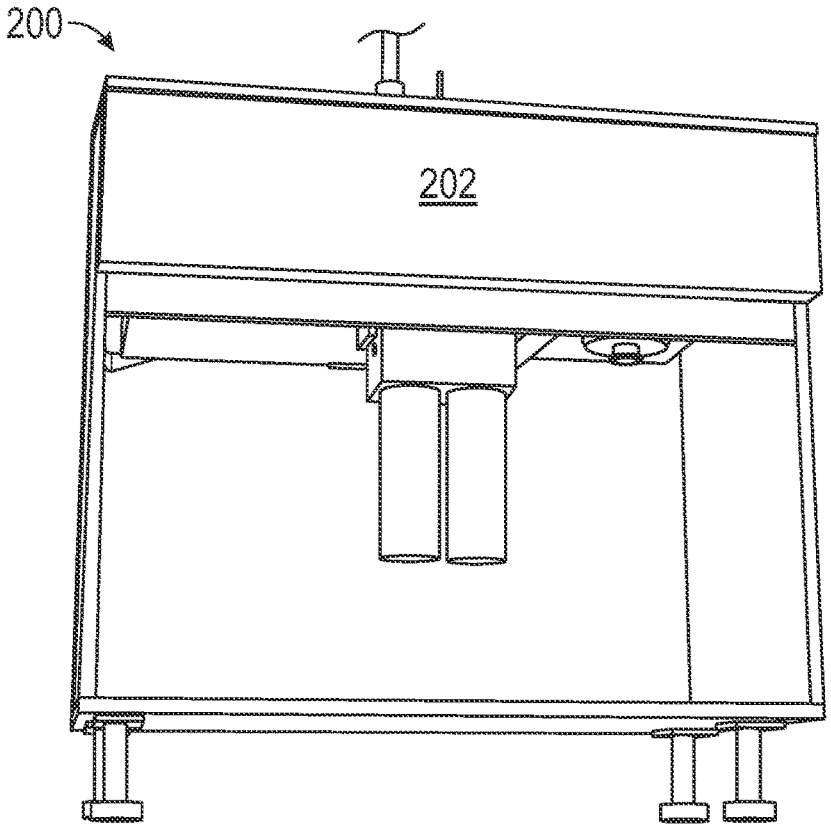
FIG. 4 depicts a front view of a faucet assembly with a retractable sprayhead, according to examples.
Figure 5:
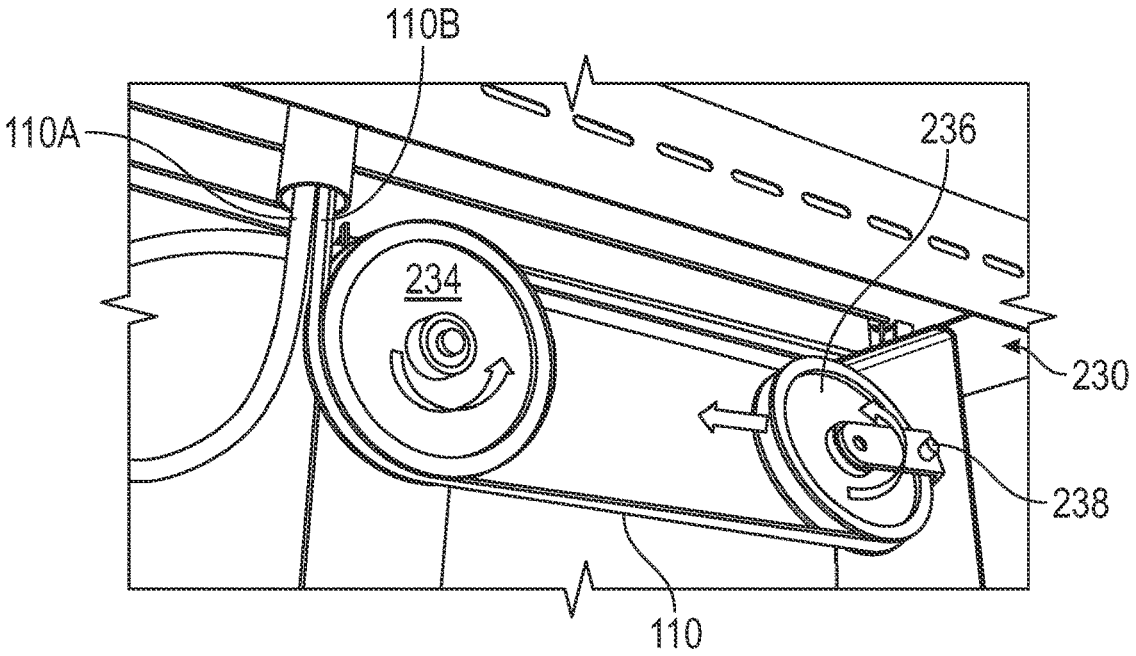
FIG. 5 depicts a cross-sectional view of a pulley/hose assembly of the faucet assembly of FIG. 4, according to examples.
Figure 6:
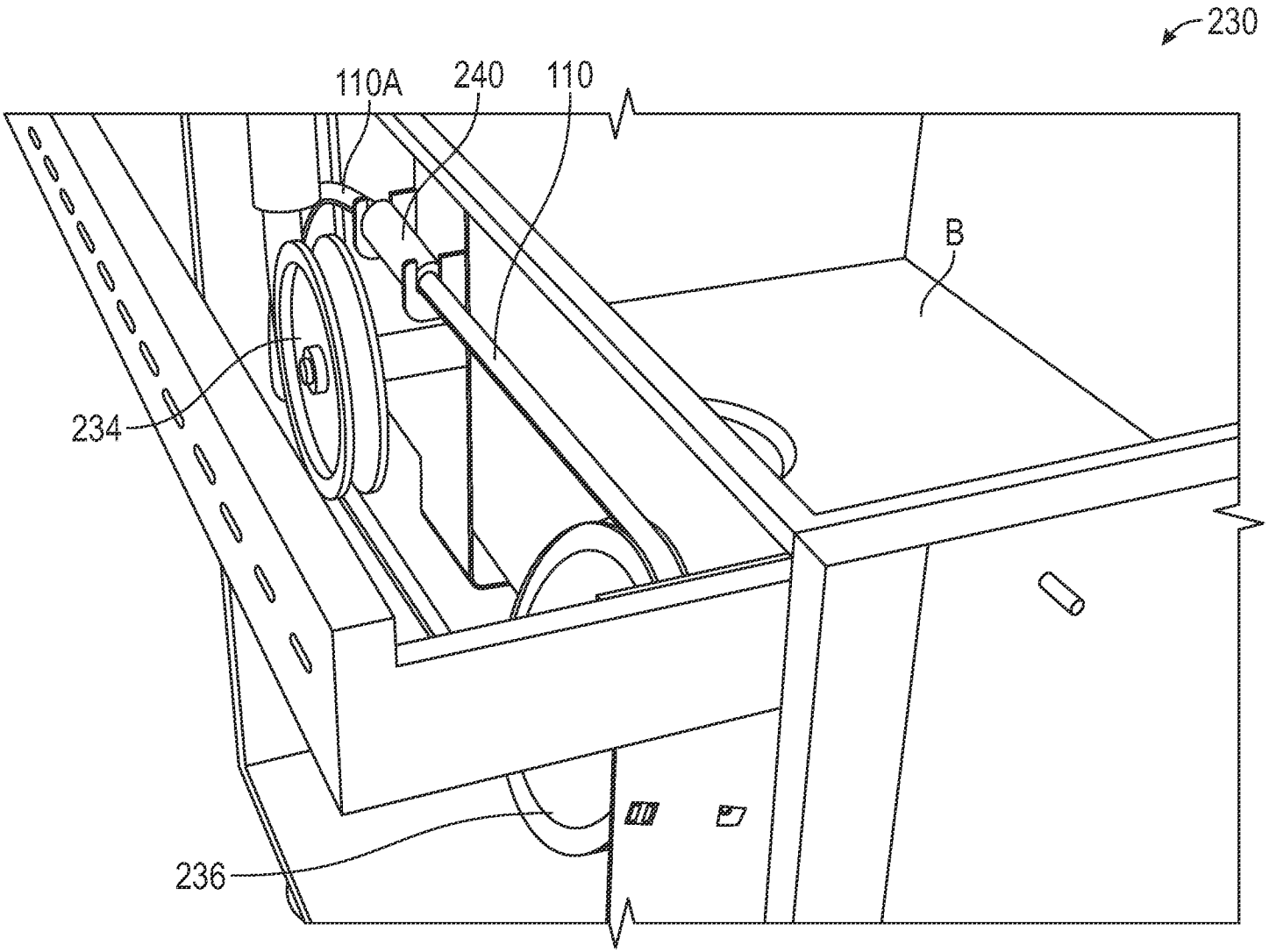
FIG. 6 depicts an above perspective view of the pulley/hose assembly of the faucet assembly of FIG. 4, according to examples.

Referring now to FIGS. 4-6, an alternative example of a sprayhead hose retraction system 200 is shown, according to examples. FIG. 4 depicts a standalone sink and faucet assembly including a cabinet structure 202, one or more sink basins (not shown), a faucet base, a spout, a sprayhead removably coupled to (e.g., received in, engaging, etc.) the spout, and a drainage assembly. In examples, the cabinet structure 202 may include a housing or otherwise enclosed structure in which a pulley/hose assembly 230 may be integrated. In examples, the existing structure of the faucet/sink may be leveraged. The sprayhead (not shown) may be operably coupled to a hose 110, as described above, having a first end 110A connected to a mixing valve positioned within the faucet (not shown), and a second end 110B operably coupled to the sprayhead (not shown). In the retracted position, the sprayhead may be coupled to and received in the spout. In examples, the sprayhead is configured to retract the sprayhead from an extended position to the retracted position via the pulley/hose assembly 230 described in greater detail below. In examples, one or more adjustable legs may be integrated with the sink and faucet assembly to manage balance of the faucet assembly.

In examples, the faucet assembly is operable to transition the sprayhead between a retracted position and an extended position. In examples, the faucet assembly may include a fully extended position and a plurality of partially extended positions. In some examples, the retraction assembly applies a force (e.g., constant force, variable force) to the hose and the sprayhead in the direction of the retracted position. Thus, if a user is using the sprayhead in an extended position (e.g., a full or partially extended position), release of the sprayhead by the user will result in the sprayhead moving toward the retracted position and re-coupling with the spout. In examples, the transition of the sprayhead between the retracted position and the extended position may be accomplished through the use of a pulley/hose assembly 230, according to examples.

FIG. 5 depicts the internal structure of a pulley/hose assembly 230 within the housing of a sink and faucet assembly, according to examples. In examples, housed within the cabinet structure 202 may be the pulley/hose assembly 230, including at least two pullies. In examples, the pullies may include a guide pulley 234 and an adjacent tension pulley 236 operably and rotatably coupled within the housing. In examples, the pullies 234 and 236 are defined with grooves configured to receive the hose 110, at least in part. In examples, the hose 110 may be coupled to the pullies 234 and 236 such that movement of the hose 110 translates to movement of the pullies 234 and 236, and vice versa. In examples, the hose 110 may be configured to be wrapped, at least partially, around the pullies 234 and 236 such that, when the faucet head transitions between the retracted and extended positions, sections of the hose 110 are taut with the pullies 234 and 236. In examples, when a user pulls on the sprayhead to transition the sprayhead out of the retracted position, the hose 110 is pulled through the spout and about/around pulley 234. In examples, when the user pulls the sprayhead, the movement of the hose 110 rotates the pullies 234 and 236 (e.g., rotating pulley 234 and tension pulley 236 clockwise) and, in turn, pulls together the tension pulley 236 closer to the guide pulley 234. This provides an extension length of hose 110 for the sprayhead out of the spout.

In examples, the tension pulley 236 may be configured to include a constant-force spring 238 therein. In examples, the constant-force spring 238 may be rotationally fixed to a position along the inner side walls of the housing 202. The constant-force spring 238 provides an amount of tension on the tension pulley 236 as the sprayhead transitions from the retracted position to the extended position. In examples, when the user releases the sprayhead, the stored energy from the stretched constant-force spring 238 is released and the tension pulley 236 is rotated counterclockwise and returned to the original resting (i.e., the completely retracted) position. Thus, when the sprayhead transitions between the retracted and extended positions, the tension pulley 236 may glide horizontally (e.g., from side to side) within the housing 202. In examples, the pullies 234 and 236 may rotate about their center axis and be configured to guide the hose 110 through the faucet assembly.

It is to be understood while two pullies are depicted, a variety of configurations are considered. In examples, greater or fewer number of pullies may be incorporated to compensate for the weight of the tension pulley 236 or the amount of tension provided by the constant-force spring 238. In examples, the constant-force spring 238 may be joined to the tension pulley 236 in other ways (e.g., adhesive, weld, rivet, etc.). In examples, the constant-force spring 238 may be coiled such that it is configured to be uncoiled when the tension pulley 236 moves toward the rotating pulley 234 as the sprayhead is undocked, transitioning from the retracted position to the extended position. The constant-force spring 238 provides a constant return force to the sprayhead regardless of how far the sprayhead is removed from the spout. In other words, the constant-force spring 238 provides a constant force to the tension pulley 236, regardless of the position of the tension pulley 236. With a traditional spring, the sprayhead would return to the spout more quickly or with more force the further it is withdrawn from the spout. In contrast to a traditional spring, the constant-force spring 238 does not respond differently the further it is withdrawn and provides the same tactile response for a user as a counterweight.

In examples, the pulley/hose assembly 230 may be configured to connect to a mixing valve, such that, prior to entering the pulley/hose assembly 230, mixed water (e.g., temperature regulated by the user, via the faucet arm/handle/etc.) has already been completed. In examples, a mixed water coupling may be secured to the faucet assembly or the pulley/hose assembly 230 to a hose extension.

Referring to FIG. 6, the second end 110*b* of hose 110 that is connected to the mixing valve, is coupled to assembly 230 via a coupling 240 secured to the housing 202. An extension of remaining hose 110 is then limited by coupling 240 to prevent overextension of hose 110, which can otherwise result in decoupling of first end 110A of the hose 110 from the mixing valve.

As depicted in FIG. 6, assembly 230 lies in a same plane as the faucet assembly, and behind a sink basin B, such that hose 110 does not interfere with components underneath basin B.

Figure 7:
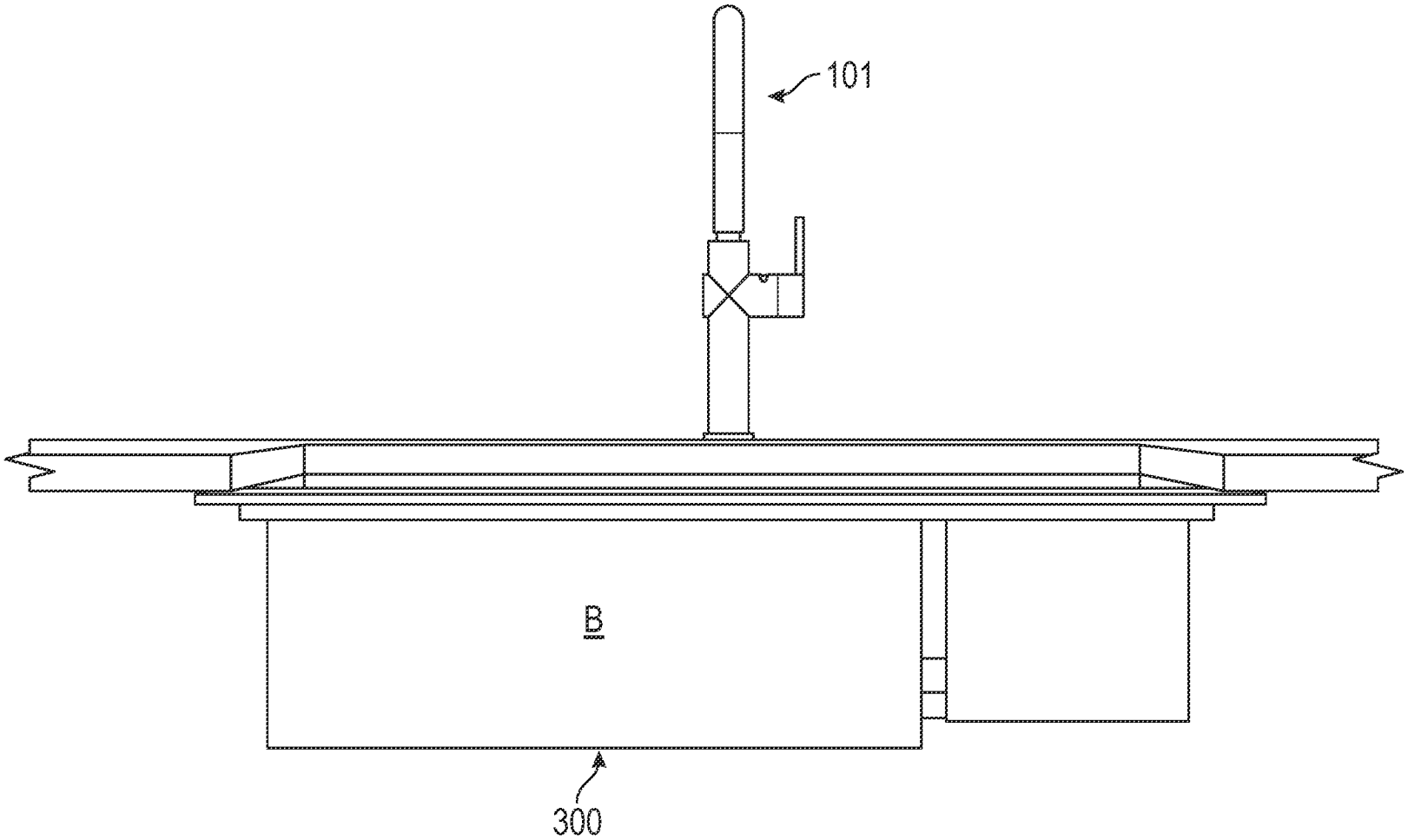
FIG. 7 depicts a front view of a faucet assembly with a retractable sprayhead, according to examples.

Referring now to FIGS. 7-12, an alternative sprayhead hose retraction system 300 for faucet assembly 101 is shown, according to examples. FIG. 7 depicts a faucet assembly 101 with similarly depicted faucet components as previously described, such as one or more sink basins B, being operably coupled, the faucet assembly including a faucet base, a spout, and a sprayhead removably coupled to (e.g., received in, engaging, etc.) the spout, etc. The sprayhead may be operably coupled to a hose configured to be extractable and retractable. In the retracted position, the sprayhead may be coupled to and received in the spout. In examples, the reversible reel system may be configured to retract the sprayhead from an extended position to the retracted position via an internal constant-force clock spring described in greater detail below.

Referring to FIGS. 8-12, the reversible reel system 302 including a single reel 304 may be secured below the faucet (e.g., within the housing) with a bracket structure 306 (e.g., a stamped steel bracket) such that the reversible reel system 302 may be self-calibrated when secured. The reversible reel system 302 may be installed on either side (i.e., left or right) of the faucet. In examples, the reversible reel 304 may include structure defining a groove running the external edges and configured to receive a length of hose 110. In examples, the hose 110 may be wrapped around the reversible reel 304, within the groove. The reversible reel 304 is configured to be rotatable about its center axis, as depicted. In examples, the reversible reel system 302 may be adapted to a range of hose lengths and sizes, while maximizing hand spray reach (i.e., the greater amount of hose wrapped around the reversible reel system 302, the greater amount of hose may be extended). In examples, the reversible reel 304 may be configured with a rotating O-ring sealed junction 309 which allows the reel to spin freely while maintaining a water seal.

In examples, the reversible reel system 302 is operable to transition the sprayhead between a retracted position and an extended position. In examples, the reversible reel system 302 may include a fully extended position (e.g., a position in which the hose 110 may no longer be extended) and a plurality of partially extended positions (e.g., a position between the fully extended position and the retracted position). As the user transitions the sprayhead into an extended position, the hose 110 extends out of the spout and is unwrapped from the reversible reel 304, out of the groove. In some examples, the reversible reel 304 may include an internal constant-force clock spring (not shown) that applies a force (e.g., constant force, variable force) to the hose 110 and the sprayhead in the direction of the retracted position, as described previously. Thus, if a user is using the sprayhead in an extended position (e.g., a full or partially extended position), release of the sprayhead by the user will result in the sprayhead transitioning toward the retracted position and re-coupling with the spout. As the sprayhead returns to the retracted position, the hose 110 continues to re-wrap around the reversible reel 304 within the groove. The reversible reel system 302 improves capacity under the faucet assembly 101, and adapts to a wide range of hose lengths and limits the number of moving pieces while maximizing the amount of extension length available for the sprayhead.

Figure 8:
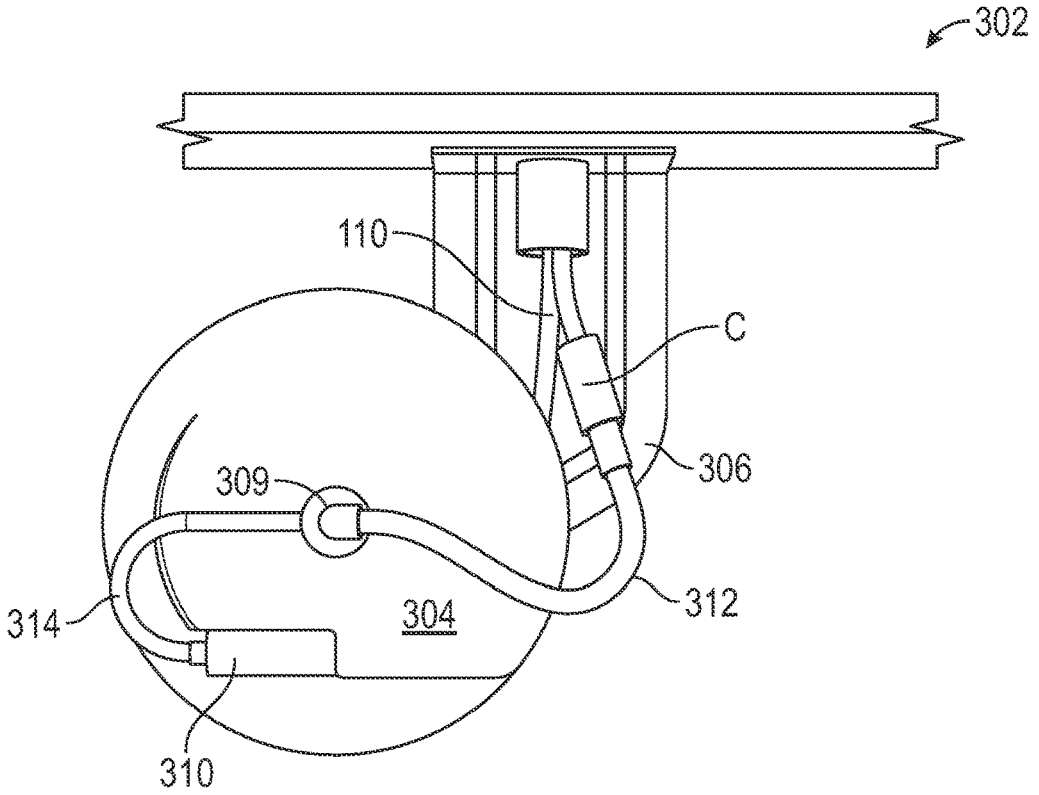
FIG. 8 depicts a first side view of a reversible reel system, according to examples.
Figure 9:
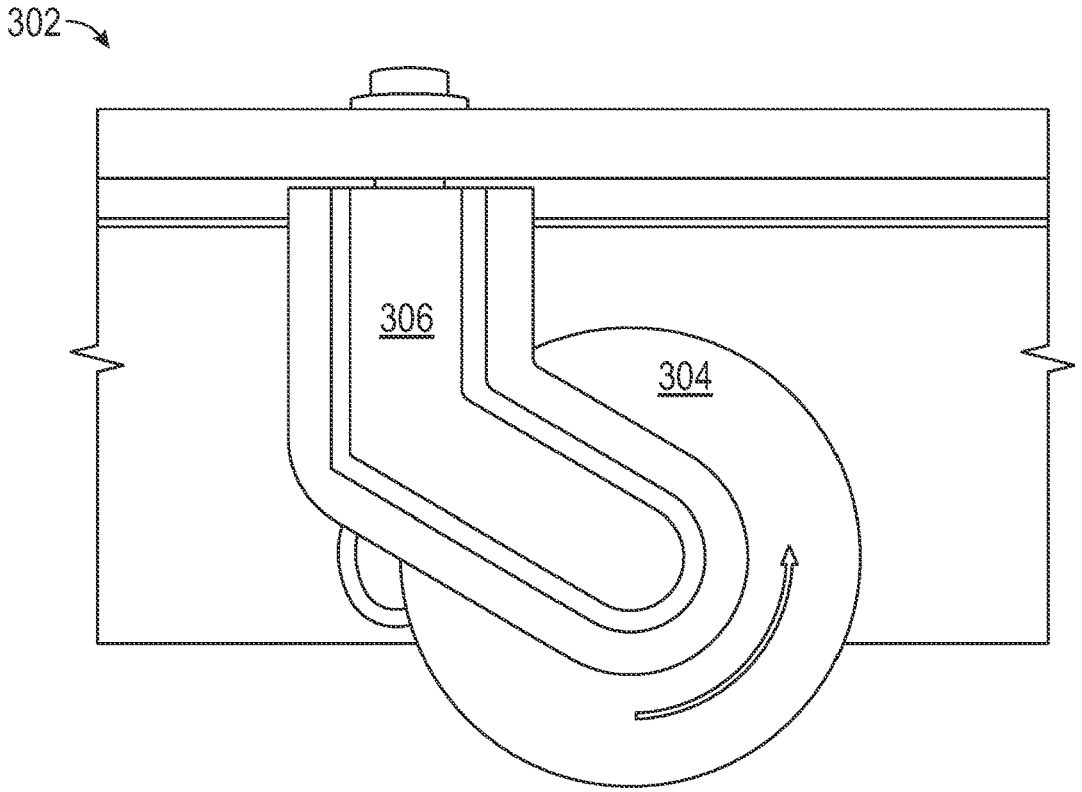
FIG. 9 depicts a second side view of a reversible reel system, according to examples.
Figure 10:
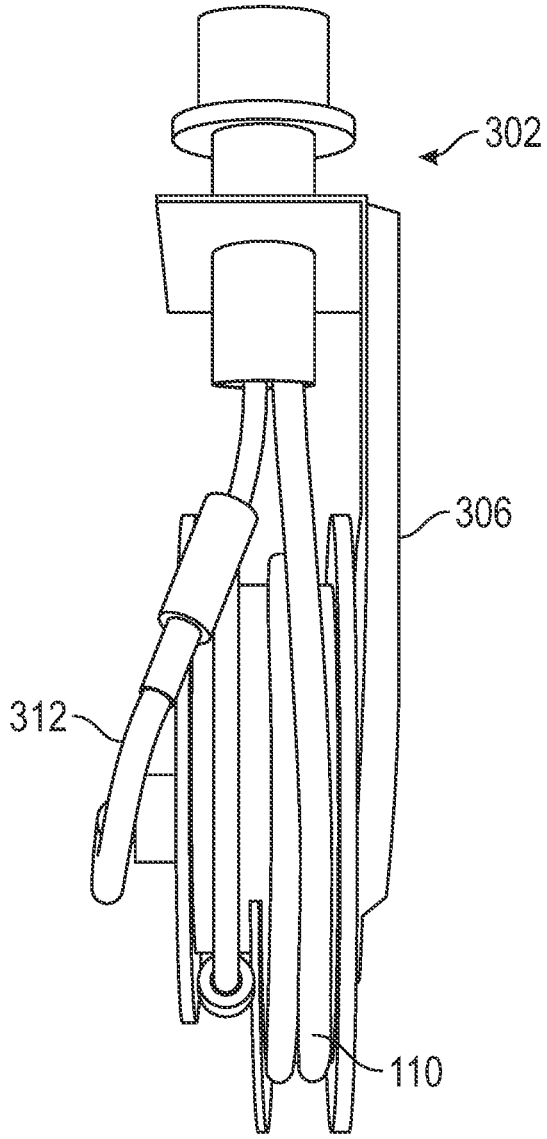
FIG. 10 depicts a third side view of a reversible reel system, according to examples.
Figure 11:
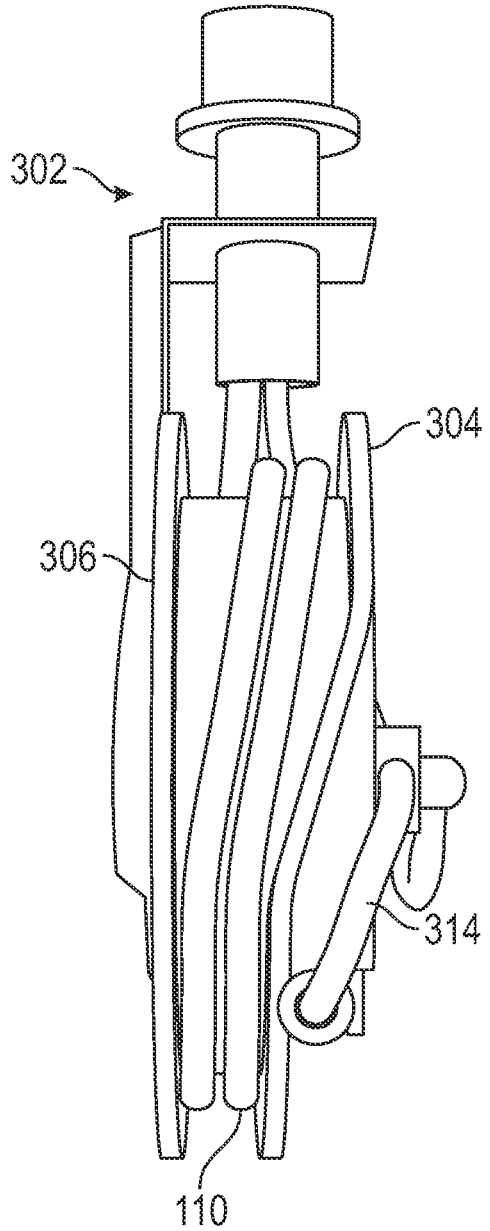
FIG. 11 depicts a fourth side view of a reversible reel system, according to examples.
Figure 12:
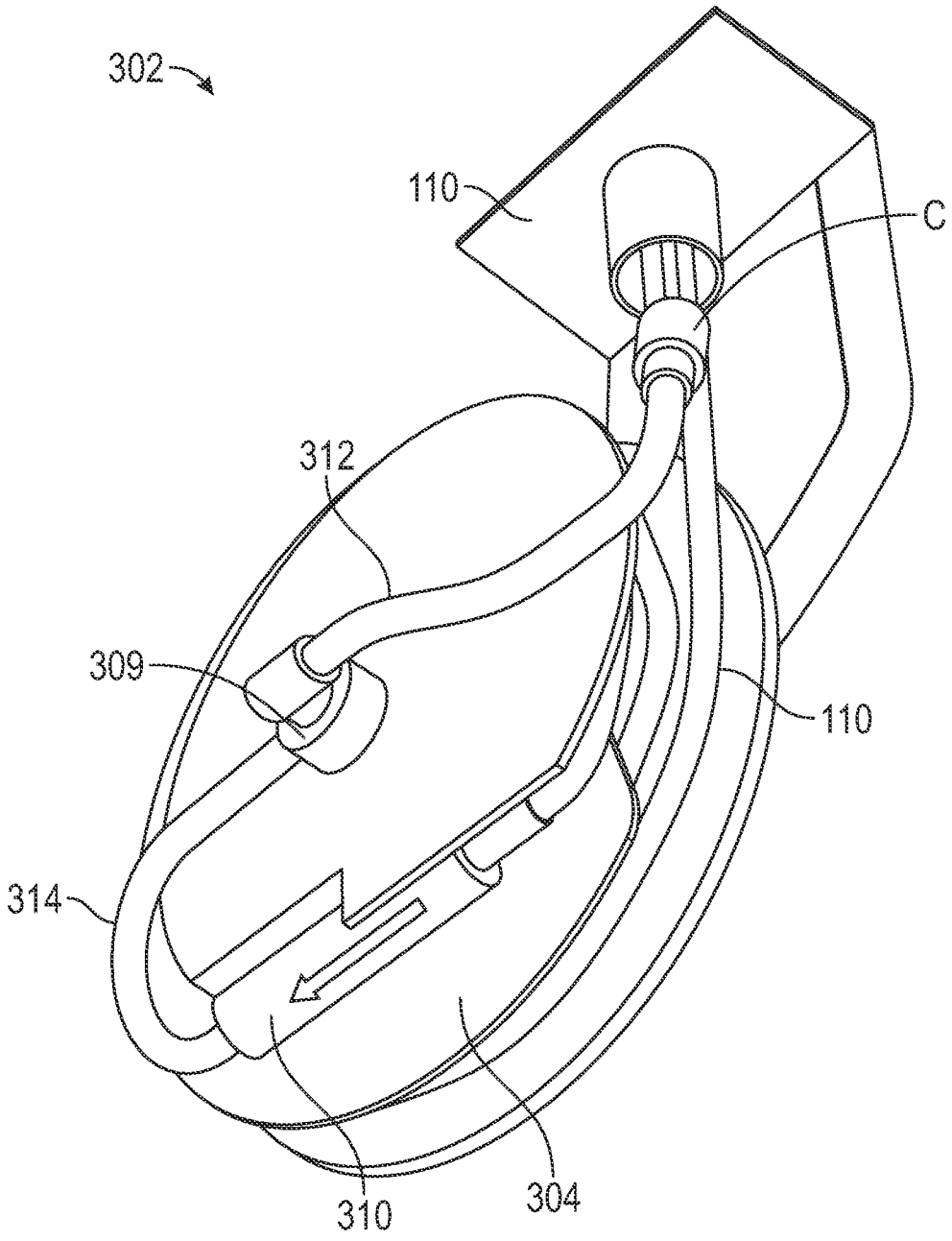
FIG. 12 depicts a perspective view of a reversible reel system, according to examples.

With additional reference to FIGS. 8 and 12, in examples, the reversible reel system 302 may be configured to connect to a mixing valve (not shown) positioned within the faucet assembly, such that, prior to entering the reversible reel system 302, mixed fluid (e.g., temperature regulated by the user, via the faucet arm/handle/etc.) has already been completed. In examples, mixed fluid may enter through a short hose 312 and rigid conduit 314 adapting the reel 304 to the faucet assembly 101, and flow through the hose (i.e., around the reversal reel system 302 if the hose is currently wrapped) and out of the sprayhead of the faucet. In examples, a connector 310 on the extension hose 110 may be incorporated such that the faucet may click or otherwise snap into the reversible reel system 302. The connector 310 provides easy installation and fluid connectivity. In examples, the connector detail of the connector 310 of the reel 304 matches a connector detail on a connector C of the faucet, such that the reversible reel system 302 can be retrofitted into an existing faucet or taken out. In examples, the geometry of the reversible reel system 302 may manage the long end-pieces on pull-out spray faucets for easier installation.

It should be understood that the individual operations used in the methods of the present teachings may be performed in any order and/or simultaneously, as long as the teaching remains operable. Furthermore, it should be understood that the apparatus and methods of the present teachings can include any number, or all, of the described examples, as long as the teaching remains operable.

Various examples of systems, devices, and methods have been described herein. These examples are given only by way of example and are not intended to limit the scope of the claimed inventions. It should be appreciated, moreover, that the various features of the examples that have been described may be combined in various ways to produce numerous additional examples. Moreover, while various materials, dimensions, shapes, configurations and locations, etc. have been described for use with disclosed examples, others besides those disclosed may be utilized without exceeding the scope of this disclosure.

Persons of ordinary skill in the relevant arts will recognize that the subject matter hereof may comprise fewer features than illustrated in any individual example described above. The examples described herein are not meant to be an exhaustive presentation of the ways in which the various features of the subject matter hereof may be combined. Accordingly, the examples are not mutually exclusive combinations of features; rather, the various examples can comprise a combination of different individual features selected from different individual examples, as understood by persons of ordinary skill in the art. Moreover, elements described with respect to one example can be implemented in other examples even when not described in such examples unless otherwise noted.

Although a dependent claim may refer in the claims to a specific combination with one or more other claims, other examples can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112 (f) are not to be invoked unless the specific terms "means for" or "step for" are recited in a claim.

What is claimed is:

1. A retractable sprayhead hose management system, comprising:

a faucet including a sprayhead;

a hose coupled to the sprayhead;

a hose assembly body coupled to the faucet, including a first opening and a second opening; and a pulley assembly including one or more first pullies coupled to a second pulley including a slidable member, wherein the one or more first pullies are coupled to the hose assembly body while maintaining rotational capability during operation, wherein the hose wraps around the second pulley such that outward extension of the sprayhead tightens the hose around the one or more first pullies and the second pulley, the second pulley being lifted as the sprayhead extends outward, the second pulley providing a force onto the hose which enables the second pulley to retract the sprayhead inward, wherein the second pulley is housed within the first opening and the slidable member is housed within the second opening, the second pulley enabled to move vertically with respect to the hose assembly within the first opening and the slidable member enabled to move vertically within the second opening.

2. The retractable sprayhead hose management system of claim 1, wherein the hose defines a first end and a second end, the first end being coupled to the sprayhead of the faucet, the second end being coupled to a fluid mixing valve positioned within the faucet.

3. The retractable sprayhead hose management system of claim 1, wherein the sprayhead is configured to transition between a retracted position and one or more extended positions.

4. The retractable sprayhead hose management system of claim 1, wherein when the sprayhead is retracted inward, a first portion of the hose is taut with the second pulley and at least one of the one or more first pullies, and a second portion of the hose is slack with the second pulley and at least one of the one or more first pullies.

5. The retractable sprayhead hose management system of claim 1, wherein extension of the sprayhead rotates the one or more first pullies which enables lifting of the second pulley along an opening defined in the hose assembly body.

6. The retractable sprayhead hose management system of claim 1, wherein inward retraction of the sprayhead enables the second pulley to return to a lower lifted position or an unlifted position.

7. The retractable sprayhead hose management system of claim 1, wherein the hose assembly body comprises a protruding knob configured to limit downward momentum of the second pulley as the sprayhead retracts inward.

8. A retractable sprayhead hose management system, comprising:

a faucet including a sprayhead;

a hose coupled to the sprayhead;

a pulley assembly including a first pulley coupled to a second pulley, the first pulley and the second pulley being coupled to the hose; and a spring coupled to the second pulley, wherein the hose wraps around the second pulley such that outward extension of the sprayhead tightens the hose around the first pulley and the second pulley and pulls the second pulley horizontally toward the first pulley, wherein the second pulley is configured to tension the spring during outward extension of the sprayhead, such that release of the tension between the second pulley and the spring enables the second pulley to retract the sprayhead inward, wherein the retractable sprayhead hose management system does not include a counterweight.

9. The retractable sprayhead hose management system of claim 8, wherein the spring is a constant-force spring configured to provide a constant force to the second pulley irrespective of the position of the second pulley.

10. The retractable sprayhead hose management system of claim 8, wherein the hose defines a first end and a second end, the first end being coupled to the sprayhead of the faucet, the second end being coupled to a fluid mixing valve positioned within the faucet.

11. The retractable sprayhead hose management system of claim 8, wherein the sprayhead is configured to transition between a retracted position and one or more extended positions.

12. The retractable sprayhead hose management system of claim 8, wherein when the sprayhead is retracted inward, a first portion of the hose is taut with the first pulley and the second pulley, and a second portion of the hose is slack with the first pulley and the second pulley.

13. The retractable sprayhead hose management system of claim 8, wherein the pulley assembly is received within a cabinet structure.

* * * * *